United States Patent [19]

Senor et al.

[11] 4,015,229

[45] Mar. 29, 1977

[54] THERMALLY RESPONSIVE SWITCH

[75] Inventors: Ronald E. Senor, North Attleboro; Frederick G. Perry, Norton, both of Mass.

[73] Assignee: Texas Instruments Incorporated, Dallas, Tex.

[22] Filed: Jan. 10, 1975

[21] Appl. No.: 535,634

[52] U.S. Cl. ..... 337/107; 337/102; 337/377

[51] Int. Cl.[2] ..... H01H 61/02

[58] Field of Search ..... 337/100, 102, 107, 77, 337/377; 219/511

[56] References Cited

UNITED STATES PATENTS

| | | | |
|---|---|---|---|
| 3,012,119 | 12/1961 | Barrett | 337/107 X |
| 3,242,292 | 3/1966 | Malone | 337/107 |
| 3,280,285 | 10/1966 | Audette | 337/107 X |
| 3,288,967 | 11/1966 | Berry | 337/102 X |
| 3,365,558 | 1/1968 | Cardin | 337/107 X |
| 3,453,577 | 7/1969 | D'Entremont | 337/100 X |
| 3,622,930 | 11/1971 | D'Entremont | 337/107 |

*Primary Examiner*—J D Miller
*Assistant Examiner*—Fred E. Bell
*Attorney, Agent, or Firm*—John A. Haug; James P. McAndrews; Harold Levine

[57] ABSTRACT

A thermostatic switch of low profile comprises a can with a stationary contact attached to the bottom of the can. A movable contact affixed to the end of a snap-acting bimetal member is positioned to make or break contact with the stationary contact. A flat heater has one end secured to a dimpled portion of a can lid and has its other end resting against the lid in insulated relation to the lid to extend generally parallel to the lid. This other end of the heater is also welded to the bimetallic member. The can and lids incorporate terminals. A gasket insulates the lid from the can and is positioned to a positive stop to a lead when inserting the lead into the lid terminal.

6 Claims, 6 Drawing Figures

THERMALLY RESPONSIVE SWITCH

BACKGROUND AND SUMMARY OF THE INVENTION

In the operation of motors, generators, transformers and other electrical apparatus, it is desirable to protect the windings and other parts thereof from excessive currents and heating. To adequately guard the safety of the apparatus, it is necessary that the protective device be placed within the appratus to assure close monitoring. With the trend toward miniaturization of motors, transformers, and generators and the like, it is necessary that protective devices be also miniaturized, at least to the extent that they may be placed within the apparatus. However, along with miniaturizing the devices comes problems with device reliability and shorting between component parts because of their close proximity to one another.

It is therefore an object of the invention to provide a thermally responsive switch which is dependable and constructed so as to not be subject to electrical shorting.

Another object of the invention is to provide a switch that may be easily calibrated.

It is yet another object of this invention to provide a switch which is inexpensive to construct and which consists of a minimum number of parts.

It is still another object of the invention to provide a switch of which the parts thereof are suitable for mass production techniques.

Other objects and features of the invention will become more readily understood from the following detailed description and appended claims, when read in conjunction with the accompanying drawings in which like reference numerals designate like parts throughout the figures thereof.

Figure 1:
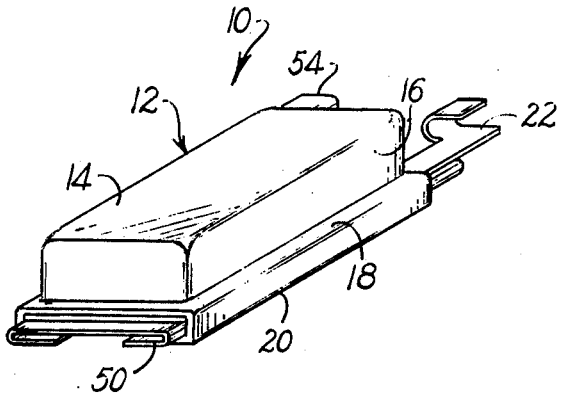
FIG. 1 is a perspective view of the switch according to the invention.
Figure 2:
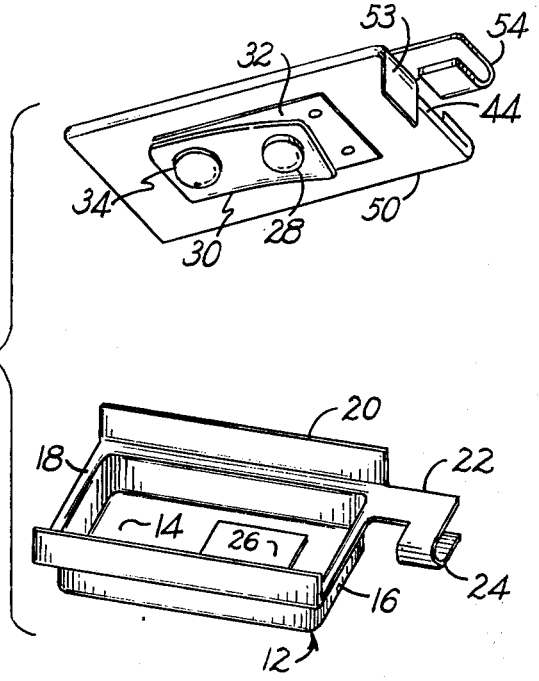
FIG. 2 is an exploded view showing the various parts of the switch.

Referring now to the drawings, a preferred embodiment of the thermally responsive switch of this invention is indicated by the numeral 10 as shown in FIG. 1. Switch 10 comprises an electrically conductive, open ended can 12 as best shown in FIG. 2 with a bottom wall 14 and upstanding side walls 16 forming a cavity therein. Attached to the free end of side walls 16 all around the perimeter is an outwardly extending flange portion 18. A downwardly extending lip portion 20 is attached preferably on two opposite sides of flange portion 18. A terminal 22 formed from an L-shaped piece of material is preferably an extension of can 12 attached at one corner to a flange portion 18 which does not have a lip portion 20 attached. The bar portion 24 of the L is bent back upon itself to form the terminal. This configuration for terminal 22 allows for welding or crimping of the lead wire. Can 12 is typically made out of one piece of material such as low carbon steel.

Attached as by welding to bottom wall 14 is a stationary contact 26. Contact 26 is made from a material of high electrical conductivity such as silver.

Figure 5:
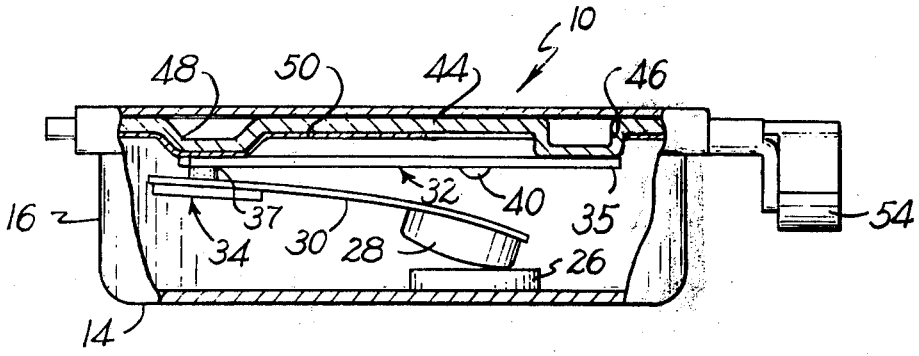
FIG. 5 is a view of the switch according to the invention with the casing partially removed and showing the switch in section along a central axis of a switch.

Positioned to be movable into and out of engagement with stationary contact 26 is a movable contact 28 as best shown in FIG. 5 preferably made from the same material as contact 26. Movable contact 28 is welded or otherwise secured at one end of a thermally responsive bimetallic member 30. Bimetallic member 30 is typically a dish-shaped element having one layer of metal of a low thermal coefficient of exapansion and another layer of metal of a somewhat higher thermal coefficient of expansion so that upon heating and cooling of member 30 it will snap between a position in which contacts 26, 28 are in engagement and one in which they are open.

Figure 3:
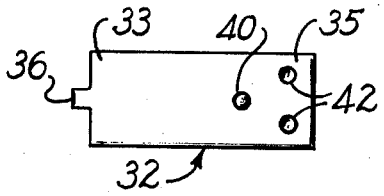
FIG. 3 is an enlarged bottom plan view of the heater element of FIGS. 2 and 5.

An opposite end of member 30 is secured as by welding to a flat heater element 32 as shown in FIG. 3 having a first end 33 and a second end 35. A slug 34 is preferably used to accurately cantilever mount member 30 to the first end 33 along side of heater 32. An aperture (not shown) is made in member 30 to receive an end portion 37 of slug 34. An end tab 36 also at the first end of heater 32 is used to locate and facilitate welding of end portion 37 to it. Slug 34 may be made from steel.

Heater element 32 also has a dimple 40 to act as a positive stop for bimetallic member 30 and weld projections 42. Heater element 32 is formed of any one of a variety of materials of selected electrical conductivity so that the element is adapted to generate a predetermined amount of heat in response to a selected flow of electrical current therethrough. For example, heater element 32 may be formed of rigid cold-rolled steel to provide the element with stability and selected electrical heating characteristics. Alternately, heater elements of other rigid metals or the like used for providing the heater with different electrical properties are within the scope of this invention.

Figure 4:
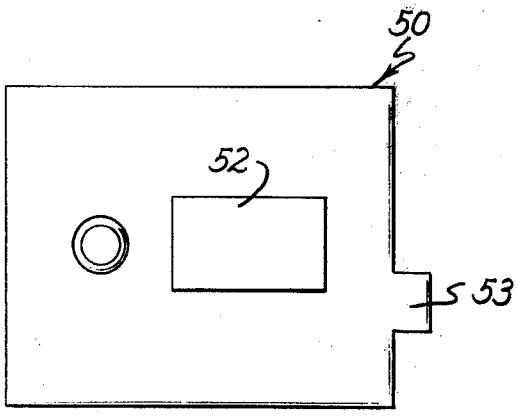
FIG. 4 is an enlarged bottom plan view of the gasket element of FIGS. 2 and 5.

In accordance with this invention a flat electrically conductive lid 44 has two dimpled portions 46, 48. A gasket 50 as shown in FIG. 4 is folded around the edges of lid 44 to electrically insulate lid 44 from can 12. A notched out portion 52 in gasket 50 is made large enough to fit first dimple 46. Second end 35 of heater element 32 with projections 42 is welded to first dimpled portion 46 and first end 33 extends in cantilever relation therefrom to rest adjacent but insulated from second dimple 48 by gasket 50. A tab 53 extends from one edge of gasket 50 and is used as a terminal stop to be discussed more below. Gasket 50 is made from an electrically insulating, compressible material such as Nomex, a trademark of Dupont, or the like.

Lid 40 insulated by gasket 50 is positioned to rest on flange portions 18 with a terminal 54 extending from lid 38 positioned adjacent terminal 22 but in the opposite corner of one of the sides of can 12. Terminal 54 is formed similar to terminal 22. Once lid 40 is positioned extending lip portion 20 is bent to clampingly engage lid 40 and gasket 50 to can 12.

Since both can 12 and lid 40 are electrically "hot", they must be insulated from metallic surfaces. This may be done by surrounding the switch with a heat shrinkable insulating tubing or encapsulating it in several varieties of epoxy resins available in the market.

To calibrate the switch and insure that it will function within the desired operating range, can 12 is forced upward at point C as shown in FIG. 5 until stationary contact 26 engages movable contact 28. Additional pressure is then applied to place an upward force on the bimetallic member 30. The engagement of flat heater element 32 with the gasket over dimple 48 makes calibration much easier because it is initially positioned against lid 40 and therefore is not able to float in the can during calibration.

In this way the switch of the invention as described above combines both miniaturization along with optimum shorting protection. The stationary contact is positioned in the bottom of can 12 to position the contacts away from gasket. This spacing assures that arcing between the contacts cannot burn through the gasket and cause shorting.

Secondly, the use of the two dimples 46, 48 in lid 40 allow the use of a flat heater for compact design and easy calibration and yet protect the gasket 50 from burn through because the heater rests against the gasket and lid over a relatively large surface area. That is, if the heater end 35 were not engaged with a substantial area of gasket 50, it might be pushed into point contact with the gasket during calibration and could cause local burnout of the gasket in area of contact.

Also, the use of the gasket tab 53 allows for quick assembly without the worry that a lead inserted into terminal 54 can short out against can 12. Gasket tab 53 provides a positive stop to the insertion of the lead.

Figure 6:
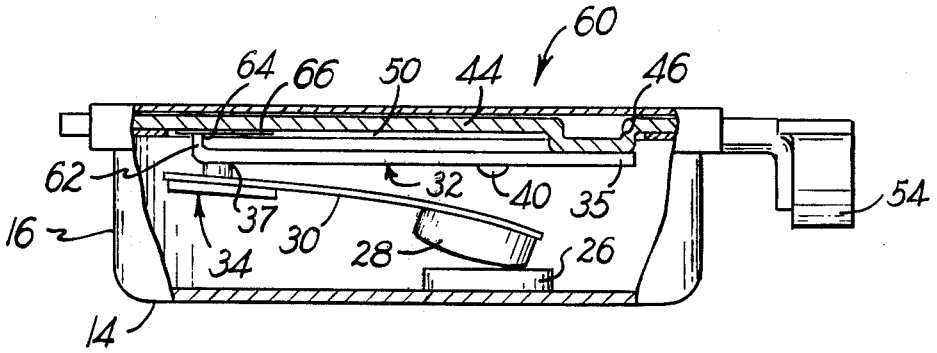
FIG. 6 is a partial section view similar to FIG. 5 illustrating an alternate embodiment of the switch of this invention.

FIG. 6 shows a second embodiment 60 of the present invention which varies from first embodiment 10 in only certain respects. In second embodiment 60 heater element 32 has a longer tab 62 with a flat end portion 64 and second dimple 48 of lid 44 is omitted. Gasket 50 has a much larger notched out portion 52 which extends the entire length of the heater element 32. A high temperature electrically insulating dot 66 is adhered to the surface of lid 44 to insulate first end 33 and more particularly end portion 64 of heater element 32 from the lid. A preferred insulating material for this purpose comprises a polymide resin such as is sold commercially under the trade name "Kapton". Dot 66 may be adhered to lid 44 by a heat sensitive adhesive.

More particularly, second end 35 of heater element 32 is attached as by welding to first dimple 46. First end 33 extends parallel to lid 44 with tab 62 bent upward so that flat end portion 64 is in contact with dot 66 which in turn is attached to lid 44. Thus, the device has a flat heater fixedly positioned for accurate calibration and compact design and an electrically insulative dot to provide shorting protection.

In view of the above, the various objects of this invention has been met.

Various additional changes and modifications in the above-described invention will be readily apparent to those skilled in the art and any such changes or modifications are deemed to be within the spirit and scope of the present invention as set forth in the appended claims.

We claim:

1. A thermostatic switch comprising an electrically conductive can having a bottom wall and upstanding side walls forming a cavity therein, an outwardly extending flange attached to the free end of the side walls with a upwardly extending lip from two opposite flange portions, a stationary contact mounted on said bottom wall, an electrically conductive lid having a dimple therein, said lid received on said flange for closing said can, an electrically insulative gasket interposed between said flange and said lid with a cut out portion fitted over said dimple, said lip being bent to clampingly engage said lid and gasket, a flat heater element welded at one end to said dimple and another end extending in cantilever relation therefrom generally parallel to said lid, means for insulating and precisely locating said other end relative to said lid, a thermostatic member cantilever mounted on said other end of said heater and extending alongside said heater, a movable contact mounted on said thermostatic member movable into and out of engagement with said stationary contact, and terminal means attached to said lid and said can respectively.

2. A thermostatic switch as set forth in claim 1 wherein said means for insulating and precisely locating said other end is an insulating dot affixed to said lid and a heater tab at said other heater end bent to be in contact with said dot.

3. A thermostatic switch comprising an electrically conductive can having a bottom wall and upstanding side walls forming a cavity therein, an outwardly extending flange attached to the free end of the side walls with an upwardly extending lip from two opposite flange portions, a stationary contact mounted on said bottom wall, an electrically conductive lid having a dimple therein, said lid received on said flange for closing said can, an electrically insulative gasket interposed between said flange and said lid with a cut out portion for said dimple, said lip bent to clampingly engage said lid and gasket, a flat heater element welded at one end to said dimple and another end extending in cantilever relation therefrom generally parallel to said lid separated from said lid by said gasket, a thermostatic member cantilever mounted on said other end of said heater and extending alongside said heater, a movable contact mounted on said thermostatic member movable into and out of engagement with said stationary contact, and terminal means attached to said lid and said can respectively.

4. A thermostatic switch as set forth in claim 3 wherein the gasket has a tab to protect against shorting when inserting a terminal lead into said lid terminal means.

5. A thermostatic switch comprising an electrical can having a bottom wall and upstandng side walls forming a cavity therein, an outwardly extending flange attached to the free end of the side wall with an upwardly extending lip from two opposite flange portions, a stationary contact mounted on said bottom wall, an electrically conductive lid having a first and a second dimple therein, said lid received on said flange for closing said can, an electrically insulative gasket interposed between said flange and said lid with a cut out portion for the first dimple, said lip bent to clampingly engage said lid and gasket, a flat heater element welded at one end to the first dimple and another end extending in cantilever relation therefrom to rest insulatively upon the second dimple, a thermostatic member cantilever mounted on said other end of said heater, a movable contact mounted on said thermostatic member movable into and out of engagement with said stationary contact, and terminal means attached to said lid and said can respectively.

6. A thermostatic switch as set forth in claim 5 wherein the gasket has a tab to protect against shorting when inserting a terminal lead into said lid terminal means.

* * * * *